US005524344A

United States Patent [19]

Bazal

[11] Patent Number: 5,524,344

[45] Date of Patent: Jun. 11, 1996

[54] SAFETY GRIP

[76] Inventor: Diana R. Bazal, 3723 W. 61st. Pl., Chicago, Ill. 60629

[21] Appl. No.: 387,184

[22] Filed: Feb. 13, 1995

[51] Int. Cl.[6] ..... A45D 29/02

[52] U.S. Cl. ..... 30/28; 30/26; 132/73; 132/75.5

[58] Field of Search ..... 30/26, 27, 28, 30/29, 85, 341; 132/73, 73.5, 75.3, 75.4, 75.5, 75.6, 76.4

[56] References Cited

U.S. PATENT DOCUMENTS

| | | | |
|---|---|---|---|
| 3,137,939 | 6/1964 | Waldeck | 30/85 |
| 4,644,644 | 2/1987 | Elsholz | 30/28 |
| 5,052,416 | 10/1991 | Rommerdale | 30/28 X |
| 5,266,849 | 7/1993 | Johnson | 30/28 |

*Primary Examiner*—Scott A. Smith
*Assistant Examiner*—Jay A. Stelacone

[57] ABSTRACT

A new and improved pair of fingernail clippers with an associated grip have an upper clipper with a first end and a second cutting end, and a lower clipper with a first end and a second cutting end. The first end of the upper clipper is connected to the first end of the lower clipper with the second cutting end of the upper clipper adapted to cooperate with the second cutting end of the lower clipper. The upper and lower clippers extend away from one another from first towards the second end. Furthermore, an aperture is formed within the upper clipper approximate the second end, and an aperture is formed within the lower clipper approximate the second end. A post having a lower end and an upper end is positioned within the aperture of the upper clipper and within the aperture of the lower clipper. A clipper lever having a first end, and a forked second end is associated with the upper clipper. The forked second end of the clipper is pivotally secured to the upper end of the post. The clipper lever has a first orientation wherein the lever extends upwardly from the upper clipper, and a second orientation wherein the clipper lever is pivoted towards the upper clipper. When the clipper lever is pivoted towards the upper clipper the upper clipper is urged towards the lower clipper and the cutting end of the upper clipper and the cutting end of the lower clipper come into engagement with one another. An elastomeric sleeve is provided which has a first closed end, a second opened end, a lower smooth surface, an upper surface and two sides. The elastomeric sleeve is adapted to be frictionally fit over the first end of the clipper lever.

1 Claim, 3 Drawing Sheets

FIG 1
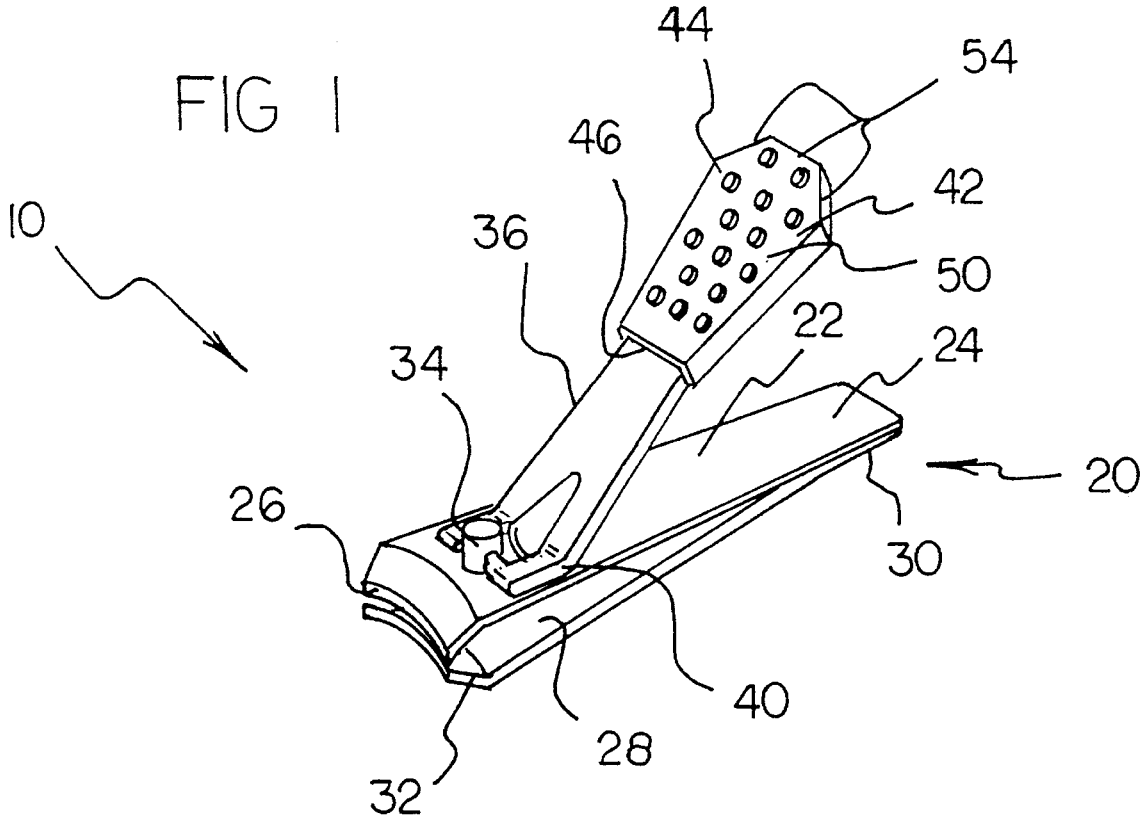
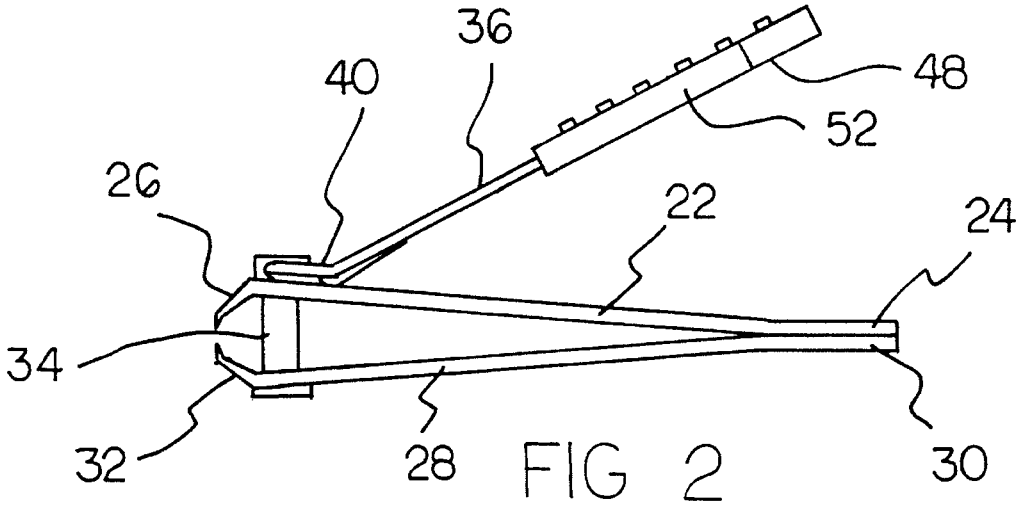
FIG 2

SAFETY GRIP

BACKGROUND OF THE INVENTION

1. Field of the Invention

The present invention relates to a safety grip and more particularly pertains to such a grip specifically adapted for use in conjunction with a pair of nail clippers.

2. Description of the Prior Art

The use of nail clippers is known in the prior art. More specifically, nail clippers heretofore devised and utilized for the purpose of personal grooming are known to consist basically of familiar, expected, and obvious structural configurations, notwithstanding the myriad of designs encompassed by the crowded prior art which has been developed for the fulfillment of countless objectives and requirements.

U.S. Pat. No. 5,101,563 to d'Orgelys, U.S. Pat. No. 4,602,430 to Allen, Jr., U.S. Pat. No. 4,176,449 to Lee et al., U.S. Pat. No. 5,063,666 to Tsay, U.S. Pat. No. 4,819,673 to McMullen, Jr. and U.S. Pat. No. 4,640,011 to Gamble all disclose nail clipper constructions.

In this respect, the a safety grip according to the present invention substantially departs from the conventional concepts and designs of the prior art, and in doing so provides an apparatus primarily developed for the purpose of providing increased gripping on a pair of nail clippers.

Therefore, it can be appreciated that there exists a continuing need for a new and improved safety grip which can be used in conjunction with nail clippers. In this regard, the present invention substantially fulfills this need.

SUMMARY OF THE INVENTION

In view of the foregoing disadvantages inherent in the known types of nail clippers now present in the prior art, the present invention provides an improved safety grip. As such, the general purpose of the present invention, which will be described subsequently in greater detail, is to provide a new and improved a safety grip and method which has all the advantages of the prior art and none of the disadvantages.

To attain this the present invention provides a pair of clippers which are constructed from an upper clipper with a first end and a second cutting end, and a lower clipper with a first end and a second cutting end. The first end of the upper clipper is connected to the first end of the lower clipper. This connection can be achieved in various ways known in the art. The connection, however, should be such as to allow the upper and lower clippers to be resiliently urged towards one another. The second cutting end of the upper clipper is adapted for cooperation with the second cutting end of the lower clipper. It is the interaction between the cutting ends of the upper and lower clippers which facilitates the cutting of a user's finger or toe nails. The upper and lower clippers extend away from one another from first towards the second end. The connection at the first ends of the clippers, as well as the material from which the clippers are constructed, enables the second ends of the clippers to be resiliently urged towards one another. With respect to materials, all of the components described herein, with the exception of the elastomeric sleeve, are constructed from a stainless steel. However, it is envisioned that other stain-resistant metals could suffice. An aperture is formed within the upper clipper approximate its second end, and an aperture is formed within the lower clipper approximate its second end. The function of these apertures will be described hereinafter. The ability of the upper and lower clippers to be urged together is achieved, in part, through a post. The post has a lower end and an upper end. The post is positioned within the aperture of the upper clipper and within the aperture of the lower clipper. Thus, the post serves in part to interconnect the upper and lower clippers as well as in aiding proper alignment between the clippers when they are urged together. The urging of the clippers is achieved through a clipper lever. The clipper lever has a first end, and a forked second end. The forked second end of the clipper is pivotally secured to the upper end of the post. The clipper lever has a first orientation wherein the lever extends upwardly from the upper clipper, and a second wherein the clipper lever is pivoted towards the upper clipper. When the clipper lever is pivoted towards the upper clipper the upper clipper is urged towards the lower clipper and the cutting end of the upper clipper and the cutting end of the lower clipper come into engagment with one another. Thus, when an operator wishes to cut something the clipper lever is urged towards the upper clipper. This in turn brings the cutting ends of the two clippers together. An elastomeric sleeve is utilized in order for the operator to get a good grip upon the clipper lever. The elastomeric sleeve has a first closed end, a second opened end, a lower smooth surface, an upper surface and two sides. The two sides diverge outwardly from the opened second end towards the first closed end. This diverging of the two sides of the sleeve enables the surface area of the sleeve to increase towards the closed end of the sleeve. The user employs more pressure at the first end of the lever, consequently the sleeve provides more surface area for contact at this first end. Furthermore, the first closed end is defined by a three sides. As illustrated in the figures, at the end of the two diverging sides, there are three more sides which define the first closed end. Two of the sides of the closed end diverge inwardly with respect to the two outwardly diverging sides. The upper surface includes a plurality of upstanding cylindrical gripping elements. These These cylindrical gripping elements are molded integrally with the rest of the sleeve and function in providing increased gripping for the user. The elastomeric sleeve is adapted to be frictionally fit over the first end of the clipper lever. Thus, the opened second end of the sleeve leads into a cavity. The cavity is dimensioned to frictionally receive the clipper lever. The entire sleeve is integrally molded from a suitable elastomeric material such as rubber. However, it is envisioned that the sleeve could be made from a polymer such as vinyl.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved safety grip which has all the advantages of the prior art nail clippers and none of the disadvantages.

It is another object of the present invention to provide a new and improved safety grip which may be easily and efficiently manufactured and marketed.

It is a further object of the present invention to provide a new and improved safety grip which is of durable and reliable constructions.

An even further object of the present invention is to provide a new and improved safety grip which is susceptible of a low cost of manufacture with regard to both materials and labor, and which accordingly is then susceptible of low prices of sale to the consuming public, thereby making such a safety grip economically available to the buying public.

Still yet another object of the present invention is to provide a new and improved safety grip which provides in the apparatuses and methods of the prior art some of the advantages thereof, while simultaneously overcoming some of the disadvantages normally associated therewith.

Even still another object of the present invention is to provide a better grip on a pair of nail clippers.

Lastly, it is an object of the present invention to provide a new and improved pair of fingernail clippers with an associated grip. The pair of clippers have an upper clipper with a first end and a second cutting end, and a lower clipper with a first end and a second cutting end. The first end of the upper clipper is connected to the first end of the lower clipper with the second cutting end of the upper clipper adapted to cooperate with the second cutting end of the lower clipper. The upper and lower clippers extend away from one another from first towards the second end. Furthermore, an aperture is formed within the upper clipper approximate the second end, and an aperture is formed within the lower clipper approximate the second end. A post having a lower end and an upper end is positioned within the aperture of the upper clipper and within the aperture of the lower clipper. A clipper lever having a first end, and a forked second end is associated with the upper clipper. The forked second end of the clipper is pivotally secured to the upper end of the post. The clipper lever has a first orientation wherein the lever extends upwardly from the upper clipper, and a second orientation wherein the clipper lever is pivoted towards the upper clipper. When the clipper lever is pivoted towards the upper clipper the upper clipper is urged towards the lower clipper and the cutting end of the upper clipper and the cutting end of the lower clipper come into engagment with one another. An elastomeric sleeve is provided which has a first closed end, a second opened end, a lower smooth surface, an upper surface and two sides. The elastomeric sleeve is adapted to be frictionally fit over the first end of the clipper lever.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the a safety grip constructed in accordance with the principles of the present invention.

FIG. 2 is a side view of the preferred embodiment of the a safety grip constructed in accordance with the principles of the present invention.

The same reference numerals refer to the same parts through the various Figures.

DESCRIPTION OF THE PREFERRED EMBODIMENT

Figure 3:
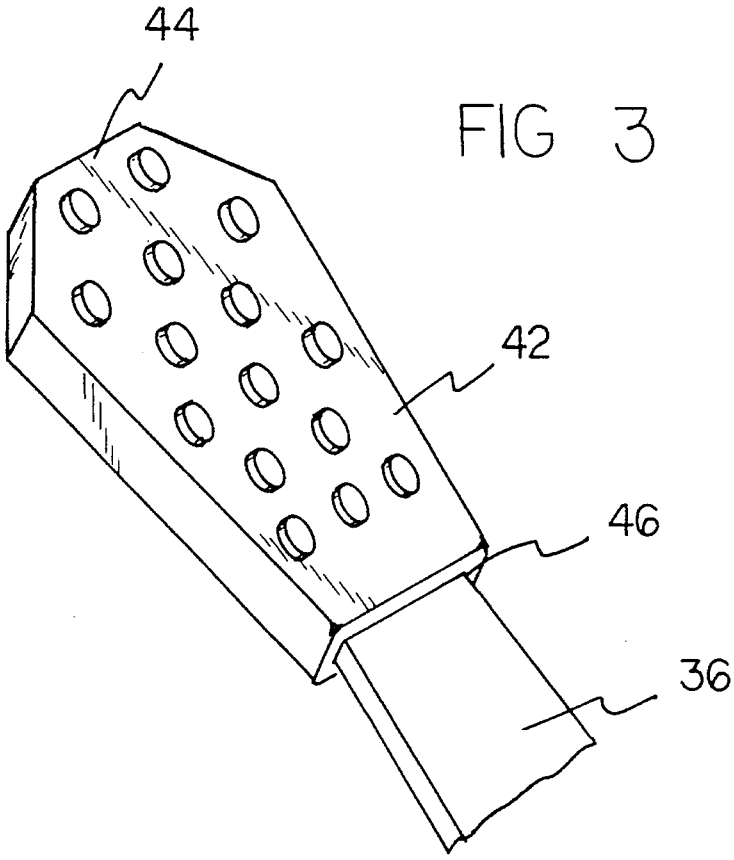
FIG. 3 is a perspective view of the a safety grip.
Figure 4:
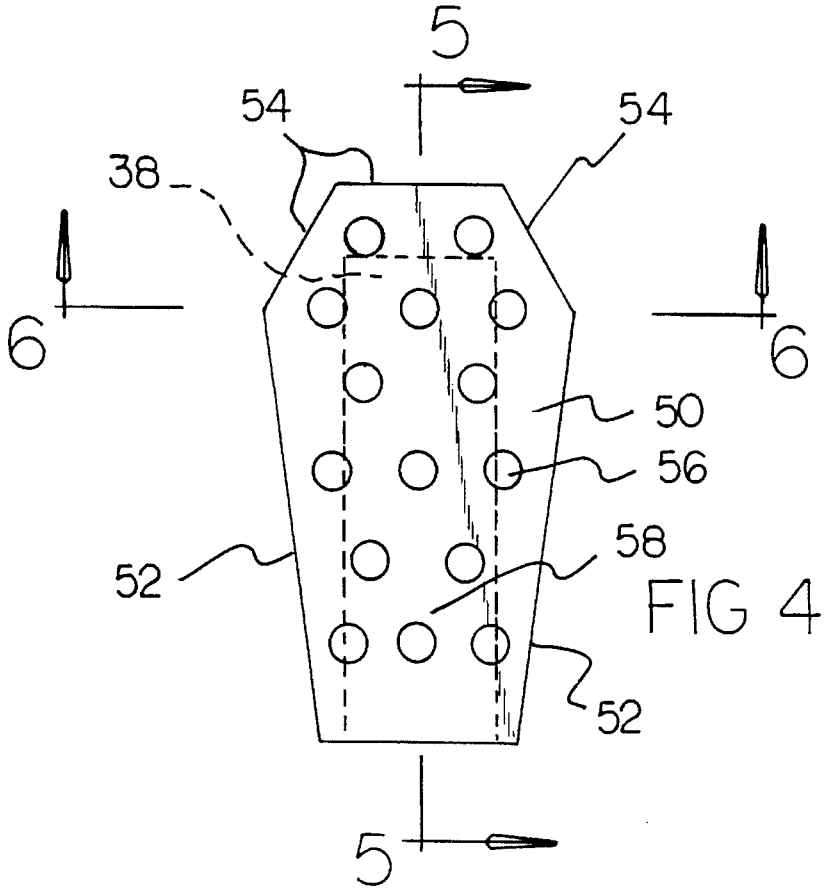
FIG. 4 is a plan view of the a safety grip with the cavity illustrated.
Figure 5:
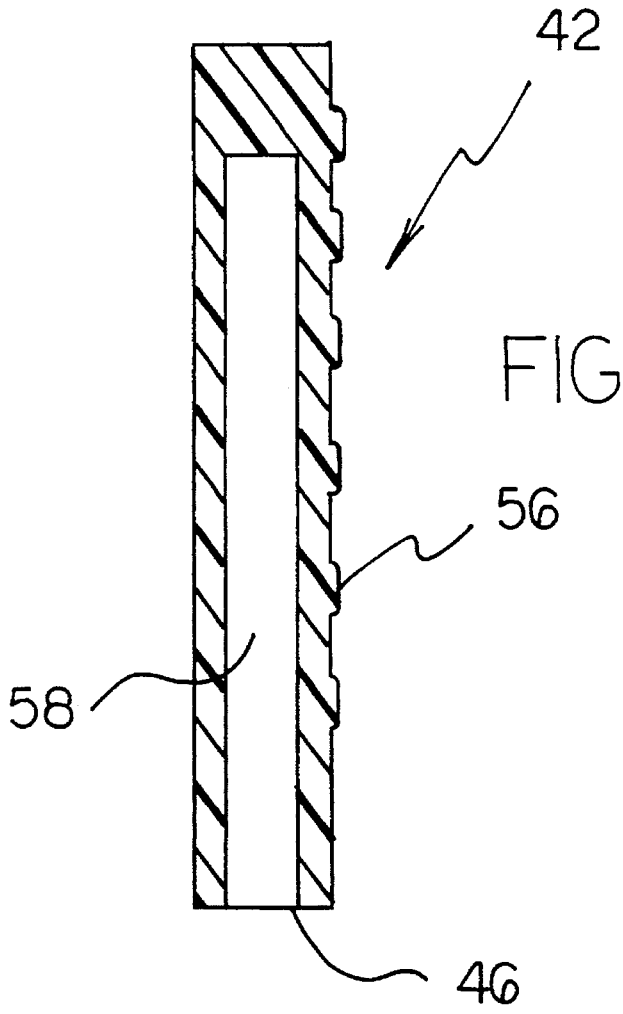
FIG. 5 is a view taken along line 5—5 of FIG. 4.
Figure 6:
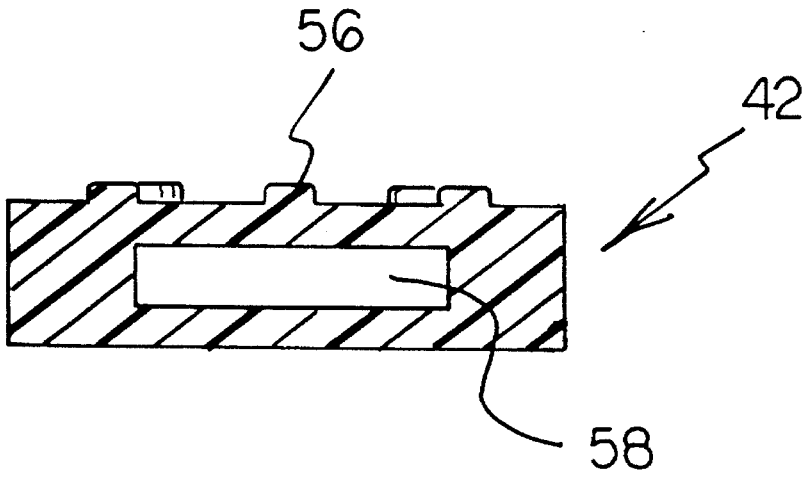
FIG. 6 is a view taken along line 6—6 of FIG. 4.

With reference now to the drawings, and in particular to FIG. 1 thereof, the preferred embodiment of the new and improved safety grip embodying the principles and concepts of the present invention and generally designated by the reference numeral 10 will be described.

The present invention relates to a pair of fingernail clippers with an associated grip portion. In its broadest context, the present invention includes a pair of fingernail clippers having an upper clipper, a lower clipper and a clipper lever which is employed in bringing the upper and lower clippers into engagement with one another. Furthermore, the present invention includes an elastomeric grip having a first closed end, and a second opened end. The grip is adapted to be frictionally fit over the end of the clipper lever. The various components of the present invention, and the manner in which they interrelate, will be described in greater detail hereinafter.

The pair of clippers 20 are constructed from an upper clipper 22 with a first end 24 and a second cutting end 26, and a lower clipper 28 with a first end 30 and a second cutting end 32. The first end 24 of the upper clipper 22 being connected to the first end 30 of the lower clipper 28. This connection can be achieved in various way known in the art. The connection, however, should be such as to allow the upper and lower clippers to be resiliently urged towards one another. The second cutting end 26 of the upper clipper 22 is adapted for cooperation with the second cutting end 32 of the lower clipper 28. It is the interaction between the cutting ends of the upper and lower clippers which facilitates the cutting of a user's finger or toe nails. The upper and lower clippers extend away from one another from first towards the second end. The connection at the first ends of the clippers, as well as the material from which the clippers are constructed, enables the second ends of the clippers to be resiliently urged towards one another. With respect to materials, all of the components described herein, with the exception of the elastomeric sleeve 42, are constructed from a stainless steel. However, it is envisioned that other stain-resistant metals could suffice. An aperture is formed within the upper clipper 22 approximate its second end, and an aperture is formed within the lower clipper 28 approximate its second end. The function of these apertures will be described hereinafter.

The ability of the upper and lower clippers to be urged together is achieved, in part, through a post 34. The post 34 has a lower end and an upper end. The post 34 is positioned within the aperture of the upper clipper 22 and within the aperture of the lower clipper 28. Thus, the post 34 serves in part to interconnect the upper and lower clippers as well as in aiding proper alignment between the clippers when they are urged together.

The urging of the clippers is achieved through a clipper lever 36. The clipper lever 36 has a first end 38, and a forked second end 40. The forked second end 40 of the clipper is pivotally secured to the upper end of the post 34. The clipper lever 36 has a first orientation wherein the lever extends upwardly from the upper clipper 22, and a second orientation wherein the clipper lever 36 is pivoted towards the upper clipper 22. When the clipper lever 36 is pivoted towards the upper clipper 22 the upper clipper 22 is urged towards the lower clipper 28 and the cutting end 26 of the upper clipper 22 and the cutting end 32 of the lower clipper 28 come into engagment with one another. Thus, when an operator wishes to cut something the clipper lever 36 is urged towards the upper clipper 22, this in turn brings the cutting ends of the two clippers together.

An elastomeric sleeve 42 is utilized in order for the operator to get a good grip upon the clipper lever 36. The elastomeric sleeve 42 has a first closed end 44, a second opened end 46, a lower smooth surface 48, an upper surface 50 and two sides 52. The two sides 52 diverge outwardly from the opened second end towards the first closed end 44. This diverging of the two sides 52 of the sleeve 42 enables the surface area of the sleeve 42 to increase towards the closed end 44 of the sleeve 42. The user employs more pressure at the first end 38 of the lever, consequently the sleeve 42 provides more surface area for contact at this first end 38. Furthermore, the first closed end 44 is defined by three sides 54. As illustrated in the Figures, at the end of the two diverging sides, there are three more sides which define the first closed end 44. Two of the sides of the closed end 44 diverge inwardly with respect to the two outwardly diverging sides.

The upper surface 50 includes a plurality of upstanding cylindrical gripping elements 56. These cylindrical gripping elements 56 are molded integrally with the rest of the sleeve 42 and function in providing increased gripping for the user. The elastomeric sleeve 42 is adapted to be frictionally fit over the first end 38 of the clipper lever 36. Thus, the opened second of the sleeve 42 leads into a cavity 58. The cavity 58 is dimensioned to frictionally receive the clipper lever. The entire sleeve 42 is integrally molded from a suitable elastomeric material such as rubber. However, it is envisioned that the sleeve 42 could be made from a polymer such as vinyl.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pair of fingernail clippers with an associated grip, the clippers comprising in combination:

a pair of clippers having an upper clipper with a first end and a second cutting end, a lower clipper with a first end and a second cutting end, the first end of the upper clipper being connected to the first end of the lower clipper, the second cutting end of the upper clipper adapted to cooperate with the second cutting end of the lower clipper, the upper clipper and the lower clipper extending away from one another from first ends of the upper clipper and the lower clipper towards the second ends of the upper clipper and the lower clipper, an aperture formed within the upper clipper approximate the second end of the upper clipper, an aperture formed within the lower clipper approximate the second end of the lower clipper;

a post having a lower end and an upper end, the post positioned within the aperture of the upper clipper and within the aperture of the lower clipper;

a clipper lever having a first end, and a forked second end, the forked second end of the clipper pivotally secured to the upper end of the post, the clipper lever having a first orientation wherein the lever extends upwardly from the upper clipper, and a second orientation wherein the clipper lever is pivoted towards the upper clipper, when the clipper lever is pivoted towards the upper clipper the upper clipper is urged towards the lower clipper and the cutting end of the upper clipper and the cutting end of the lower clipper come into engagement with one another;

an elastomeric sleeve having a first closed end, a second opened end, a lower smooth surface, an upper surface and two sides, the two sides diverging outwardly from the opened second end towards the first closed end, the first closed end being defined by three sides, the lower surface, the upper surface, the two sides, and the first closed end together defining a cavity, the upper surface including a plurality of upstanding cylindrical gripping elements, the elastomeric sleeve adapted to be fictionally fit over the first end of the clipper lever.

* * * * *